US006541924B1

(12) United States Patent
Kane et al.

(10) Patent No.: US 6,541,924 B1
(45) Date of Patent: Apr. 1, 2003

(54) METHODS AND SYSTEMS FOR PROVIDING EMISSION OF INCOHERENT RADIATION AND USES THEREFOR

(75) Inventors: Deborah Maree Kane, North Epping (AU); Richard Paul Mildren, Mosman (AU); Robert John Carman, North Epping (AU)

(73) Assignee: Macquarie Research Ltd., New South Wales (AU)

( * ) Notice: Subject to any disclaimer, the term of this patent is extended or adjusted under 35 U.S.C. 154(b) by 165 days.

(21) Appl. No.: 09/660,021

(22) Filed: Sep. 12, 2000

(30) Foreign Application Priority Data

Apr. 14, 2000 (AU) ..... PQ6907
Jun. 15, 2000 (AU) ..... PQ8176

(51) Int. Cl.[7] ..... H05B 41/00

(52) U.S. Cl. ..... 315/246; 315/268; 315/169.3; 313/607

(58) Field of Search ..... 315/169.3, 246, 315/268, 224, DIG. 5; 313/607

(56) References Cited

U.S. PATENT DOCUMENTS

| | | | |
|---|---|---|---|
| 5,099,557 A | 3/1992 | Engelsberg | 29/25.01 |
| 5,364,645 A | 11/1994 | Lagunas-Solar et al. | 426/248 |
| 5,455,074 A | 10/1995 | Nohr et al. | 427/386 |
| 5,604,410 A | 2/1997 | Vollkommer et al. | 315/246 |

(List continued on next page.)

OTHER PUBLICATIONS

Eliasson, B. et al."UV Excimer Radiation from Dielectric–Barrier Discharges" *Applied Physics B* vol. 46 (1988) pp 299–303.

Kogelschatz, U. et al. "Dielectric–Barrier Discharges. Principle and Applications" *J. Phys. IV France* vol. 7 (1997) pp 47–66.

Massines, F. et al. "Experimental and Theoretical Study of a Glow Discharge at Atmospheric Pressure Controlled by Dielectric Barrier" *J. Applied Physics* vol. 83 (1998) pp 2950–2957.

Pashaie, R. et al. "Experimental Investigation of Microdischarges in a Dielectric–Barrier Discharge" *IEEE Transactions of Plasma Science* vol. 27, No. 1 (1999) pp 22–23.

Mildren, R.P. et al. "Enhanced Efficiency from a Xe Excimer Barrier Discharge Lamp . . . Excitation" *Proceedings on SPIE* vol. 4071 (2000) pp 283–290 Eds. Tarasenko, V.F. et al.

Vollkommer, F. et al. "Dielectric Barrier Discharge" *Proc. 8th Int. Symp. On Sci. and Tech. Of Light Sources* (1998) pp 51–60.

*Primary Examiner*—Don Wong
*Assistant Examiner*—Ephrem Alemu
(74) *Attorney, Agent, or Firm*—Ladas & Parry

(57) ABSTRACT

Methods and systems for providing emission of incoherent radiation and uses therefor are disclosed. A system for providing emission of high peak power (in watts) incoherent radiation, comprises an electrically impeded discharge lamp linked to an electrical energy supply. The lamp comprises a discharge chamber which is at least partially transparent to the incoherent radiation, a discharge gas in the chamber, two electrodes disposed with respect to the chamber for discharging electrical energy therebetween, at least one dielectric barrier disposed between the two electrodes to electrically impede electrical energy passing between the two electrodes, an electrical energy supply capable of providing fast risetime, high peak power unipolar linking the electrodes with the supply, the energy supply being capable of providing a sequence of high peak power unipolar voltage pulses from the energy supply to the electrodes and means to control (i interpulse period, and (ii) pulse risetime, whereby, in use, a substantially homogeneous discharge occurs between the two electrodes which causes emission of incoherent radiation pulses of high peak power from the lamp.

14 Claims, 7 Drawing Sheets

U.S. PATENT DOCUMENTS 5,821,175 A 10/1998 Engelsberg ..... 438/795
5,831,394 A * 11/1998 Huber et al. ..... 315/219
5,965,988 A * 10/1999 Vollkommer et al. ..... 315/246
5,994,849 A * 11/1999 Vollkommer et al. ..... 313/607
6,084,360 A * 7/2000 Yokokawa et al. ..... 313/607
6,310,442 B1 * 10/2001 Vollkommer et al. ..... 315/246
6,376,989 B1 * 4/2002 Vollkommer et al. ... 315/209 R

* cited by examiner

METHODS AND SYSTEMS FOR PROVIDING EMISSION OF INCOHERENT RADIATION AND USES THEREFOR

TECHNICAL FIELD

This invention relates to methods and systems for providing emission of incoherent radiation and uses for therefor.

BACKGROUND ART

Currently, commercial dielectric barrier discharge (DBD) lamp sources of incoherent ultraviolet (UV) are inherently low-peak power and are poorly suited to many practical applications Alternative sources of high-peak power UV radiation (laser-based) are comparatively high-cost and not cost-effective for many desired industrial processes. Dielectric barrier discharge lamps used to generate ultraviolet output generally employ electrical excitation schemes based on an AC voltage waveform (50 Hz–200 kHz). Although the UV emitted by the plasma can be generated with high efficiency (~10–20%) and with high average power, the present inventors have realised that the UV output has inherently low-peak power due to the dynamics of the plasma excitation when using AC excitation.

OBJECTS OF THE INVENTION

It is an object of this invention to provide methods and systems for providing emission of incoherent radiation and uses therefor.

DISCLOSURE OF INVENTION

According to a first embodiment of this invention there is provided a method of operating a system for providing emission of incoherent radiation, said system comprising an electrically impeded discharge lamp linked to an electrical energy supply, said lamp comprising:

(a) a discharge chamber which is at least partially transparent to said incoherent radiation;

(b) a discharge gas in said chamber;

(c) two electrodes disposed with respect to said chamber for discharging electrical energy there between;

(d) at least one dielectric barrier disposed between said two electrodes to electrically impede electrical energy passing between said two electrodes;

(e) an electrical energy supply capable of providing fast risetime unipolar voltage pulses;

(f) means of electrically linking said electrodes with said supply; said method comprising:

providing a sequence of unipolar voltage pulses from said energy supply to said electrodes and controlling (i) interpulse period, an (ii) pulse risetime, whereby a substantially homogeneous discharge occurs between said two electrodes which causes emission of pulses of incoherent radiation from said lamp.

According to a second embodiment of this invention there is provided a method of operating a system for providing emission of high peak power incoherent radiation, said system comprising an electrically impeded discharge lamp linked to an electrical energy supply, said lamp comprising:

(a) a discharge chamber which is at least partially transparent to said incoherent radiation;

(b) a discharge gas in said chamber;

(c) two electrodes disposed with respect to said chamber for discharging electrical energy there between;

(d) at least one dielectric barrier disposed between said two electrodes to electrically impede electrical energy passing between said two electrodes;

(e) an electrical energy supply capable of providing fast risetime, high peak unipolar voltage pulses;

(f) means of electrically linking said electrodes with said energy supply; said method comprising;

providing a sequence of high peak power unipolar voltage pulses from said energy supply to said electrodes and controlling (i) interpulse period, and (ii) pulse risetime, whereby a substantially homogeneous discharge occurs between said two electrodes which causes emission of incoherent radiation pulses of high peak power from said lamp.

According to a third embodiment of this invention there is provided a system for providing emission of incoherent radiation, said system comprising an electrically impeded discharge lamp linked to an electrical energy supply, said lamp comprising:

(a) a discharge chamber which is at least partially transparent to said incoherent radiation;

(b) a discharge gas in said chamber;

(c) two electrodes disposed with respect to said chamber for discharging electrical energy there between;

(d) at least one dielectric barrier disposed between said two electrodes to electrically impede electrical energy passing between said two electrodes;

(e) an electrical energy supply capable of providing fast risetime unipolar voltage pulses;

(f) means of electrically linking said electrodes with said energy supply;

said energy power supply being capable of providing a sequence of unipolar voltage pulses from said energy supply to said electrodes; and means to control (i) interpulse period, and (ii) pulse risetime, whereby, in use, a substantially homogeneous discharge occurs between said two electrodes which causes emission of pulses of incoherent radiation from said lamp.

According to a fourth embodiment of this invention there is provided a system for providing emission of high peak power (in watts) incoherent radiation, said system comprising an electrically impeded discharge lamp linked to an electrical energy supply, said lamp comprising:

(a) a discharge chamber which is at least partially transparent to said incoherent radiation;

(b) a discharge gas in said chamber;

(c) two electrodes disposed with respect to said chamber for discharging electrical energy there between;

(d) at least one dielectric barrier disposed between said two electrodes to electrically impede electrical energy passing between said two electrodes;

(e) an electrical energy supply capable of providing fast risetime, high peak unipolar voltage pulses;

(f) means of electrically linking said electrodes with said supply;

said energy supply being capable of providing a sequence of high peak unipolar voltage pulses from said energy supply to said electrodes; and means to control (i) interpulse period, and (ii) pulse risetime, whereby, in use, a substantially homogeneous discharge occurs between said two electrodes which causes emission of incoherent radiation pulses of high peak power from said lamp.

Other embodiments of the invention include:

(1) a method of releasing contaminants from a surface by irradiating the surface with incoherent radiation pulses generated by a method of the invention, said pulses being of sufficient intensity ($W/cm^2$) to release said contaminants from said surface;

(2) a method of modifying a surface by irradiating the surface with incoherent radiation pulses generated by a method of the invention, said pulses being of sufficient intensity to modify said surface;

(3) a method of ablating/etching a material by irradiating the material with incoherent radiation pulses generated by a method of the invention, said pulses being of sufficient intensity to ablate/etch said surface;

(4) a method of pumping a laser active medium by irradiating the active medium with incoherent radiation pulses generated by a method of the invention, said pulses being of sufficient intensity to pump said active medium;

(5) a method of killing micro-organisms and/or bacteria by irradiating the bacteria with incoherent radiation pulses generated by a method of the invention, said pulses being of sufficient intensity to kill said micro-organisms and/or bacteria;

(6) a method of irradiating an object with incoherent radiation pulses generated by a method of the invention, comprising irradiating said object with said pulses;

(7) a method of removing surface contaminants by irradiating the surface with incoherent radiation pulses generated by a method of the invention, comprising irradiating said surface with said pulses using various methods to achieve inert gas flow over the irradiated surface, said pulses being of sufficient intensity to remove said surface contaminants (see U.S. Pat. No. 5,821,175 for methods to achieve inert gas flow over the irradiated surface);

(8) a method of controlling insects and/or mites by irradiating the insects and/or mites with incoherent radiation pulses generated by a method of the invention, said pulses being of sufficient intensity to kill said insects and/or mites;

(9) a system for releasing contaminants from a surface said system being capable of irradiating the surface with incoherent radiation pulses, said pulses being of sufficient intensity to release said contaminants from said surface;

(10) a system for modifying a surface said system being capable of irradiating the surface with incoherent radiation pulses, said pulses being of sufficient intensity to modify said surface;

(11) a system for ablating/etching a material said system being capable of irradiating the material with incoherent radiation pulses, said pulses being of sufficient intensity to ablate/etch said surface;

(12) a system for pumping a laser active medium said system being capable of irradiating the medium with incoherent radiation pulses, said pulses being of sufficient intensity to pump said active medium;

(13) a system for killing micro-organisms and/or bacteria said system being capable of irradiating the bacteria with incoherent radiation pulses, said pulses being of sufficient intensity to kill said micro-organisms and/or bacteria;

(14) a system of removing surface contaminants said system being capable of irradiating the surface with incoherent radiation pulses, said pulses being of sufficient intensity to remove said surface contaminants;

(15) a system of controlling or killing insects and/or mites said system being capable of irradiating the insects and/or mites with incoherent radiation pulses, said pulses being of sufficient intensity to control or kill said insects and/or mites;

Typically the two electrodes are disposed in the chamber.

The methods of the invention usually comprise:

providing a sequence of unipolar voltage pulses from said energy supply to said electrodes, and controlling (i) interpulse period, (ii) pulse risetime, and (iii) pulse width, whereby a substantially homogeneous discharge occurs between said two electrodes which causes emission of pulses of incoherent radiation from said lamp.

The methods of the invention may comprise:

providing a sequence of unipolar voltage pulses from said energy supply to said electrodes and controlling (i) interpulse period, (ii) pulse risetime, (iii) pulse width, (iv) interpulse voltage level, and (v) unipolar pulse voltage level; whereby a substantially homogeneous discharge occurs between said two electrodes which causes emission of pulses of incoherent radiation from said lamp.

The systems of the invention usually comprise:

means to control (i) interpulse period, (ii) pulse risetime, and (iii) pulse width, whereby, in use, a substantially homogeneous discharge occurs between said two electrodes which causes emission of pulses of incoherent radiation from said lamp.

The systems of the invention may comprise:

means to control (i) interpulse period, (ii) pulse risetime, (iii) pulse width, (iv) interpulse voltage level, and (v) unipolar pulse voltage level; whereby, in use, a substantially homogeneous discharge occurs between said two electrodes which causes emission of pulses of incoherent radiation from said lamp.

More typically the high peak power methods of the invention comprise:

providing a sequence of unipolar voltage pulses from said energy supply to said electrodes and controlling (i) interpulse period, (ii) pulse risetime, and (iii) pulse width, whereby a substantially homogeneous discharge occurs between said two electrodes which causes emission of pulses of incoherent radiation of high peak power from said lamp.

The high peak power methods of the invention may comprise:

providing a sequence of unipolar voltage pulses from said energy supply to said electrodes and controlling (i) interpulse period, (ii) pulse risetime, (iii) pulse width, (iv) interpulse voltage level, and (v) unipolar pulse voltage level; whereby a substantially homogeneous discharge occurs between said two electrodes which causes emission of pulses of incoherent radiation of high peak power from said lamp.

More typically the high peak power systems of the invention comprise:

means to control (i) interpulse period, (ii) pulse risetime, and (iii) pulse width, whereby, in use, a substantially homogeneous discharge occurs between said two electrodes which causes emission of pulses of incoherent radiation of high peak power from said lamp.

The high peak power systems of the invention may comprise:

means to control (i) interpulse period, (ii) pulse risetime, (iii) pulse width, (iv) interpulse voltage level, and (v)

unipolar pulse voltage level; whereby, in use, a substantially homogeneous discharge occurs between said two electrodes which causes emission of pulses of incoherent radiation of high peak power from said lamp.

The chamber may have a discharge gas inlet and a discharge gas outlet. The discharge gas pump may be linked to the chamber to either increase or reduce and/or provide discharge gas to the chamber. A supply of discharge gas may be linked to the chamber.

At high peak power, one pulse of UV/VUV emission is observed following the application of each unipolar voltage pulse and passage of the associated discharge current pulse. At high peak power the output of the discharge chamber comprises high output pulse energy (in joules) (within ~20%, more usually within ~10% of the maximum output pulse energy) and small output pulse width (in nanoseconds) (within ~20%, more usually within ~10% of minimum output pulse width). Usually to generate UV/VUV output with high peak power characteristics, the specific operating conditions of the discharge chamber or lamp should be selected so as to substantially maximise the output pulse energy (in joules) and substantially minimise the output pulse width (in nanoseconds). By monitoring a typical UV/VUV pulse emitted by the lamp of known (fixed) surface area, high peak power operation can be characterised by measuring the instantaneous peak output power (in watts) which should be substantially maximised in amplitude.

The systems and/or methods of the invention may include means to control the amplitude of the unipolar voltage pulses, means to control pressure and/or temperature of said discharge gas, and means to control pulse width.

The systems and/or methods of the invention may include means to adjust the amplitude of the unipolar voltage pulses (e.g. an adjustable power supply), means to adjustably control gas pressure in the discharge chamber (e.g. via an adjustable gas pressure supply to the discharge chamber) and/or temperature of said discharge gas (e.g. via an adjustable temperature controller to a heat element coupled or operably associated with the discharge chamber), means to adjustably control pulse interpulse period (e.g. an adjustable power supply), means to adjustably control pulse width (e.g. via an adjustable power supply), means to adjustably control interpulse voltage level (e.g. via an adjustable power supply), and/or means to adjustably control pulse risetime (e.g. via an adjustable power supply).

The systems and/or methods of the invention may include means to detect the amplitude of the unipolar voltage pulses (e.g. an oscilloscope or voltmeter), means to detect pressure (e.g. a pressure gauge) and/or temperature (e.g. a thermocouple linked to appropriate electronics) of said discharge gas, means to detect interpulse period (e.g. an oscilloscope or voltmeter), means to detect pulse width, amplitude and/or means to detect pulse risetime (e.g. an oscilloscope means to detect interpulse voltage level (e.g. an oscilloscope or voltmeter), and/or means to detect discharge current (e.g. an oscilloscope or ammeter).

The systems and/or methods of the invention may include means to trigger the energy pulse.

The systems and/or methods of the invention may include means to monitor the amplitude of the unipolar voltage pulses pulses (e.g. an oscilloscope or voltmeter), means to monitor pressure (e.g. a pressure gauge or a pressure detector linked to appropriate electronics) and/or temperature (e.g. a thermocouple linked to appropriate electronics) of said discharge gas, means to monitor pulse idle time pulses (e.g. an oscilloscope or voltmeter), means to monitor pulse width pulses (e.g. an oscilloscope), and/or means to monitor pulse risetime (e.g. an oscilloscope), and/or means to monitor discharge current (e.g. an ammeter).

The systems and the methods of the invention may include means to adjust the composition of the discharge gas.

The systems,and methods of the invention may include means to detect the emission of incoherent radiation pulses. The systems and methods of the invention may include means to detect the emission of incoherent radiation pulses and to measure the intensity of the pulses.

The systems and methods of the invention may include means to focus the emitted incoherent light.

The embodiments of the invention provide methods of and systems for generating light usually ultraviolet light or vacuum ultraviolet light from dielectric barrier discharges (DBD). The methods generate and the systems are capable of generating UV or VUV pulses of short duration (100–500 ns) and, where required, high-peak power UV or VUV pulses. This has been made possible through the use of electrical circuits, which supply single-pulse voltage waveforms of short duration (typically up to 5 $\mu$s, more typically tip to 1 $\mu$s) and operating procedures to "synchronise" excitation of the plasma throughout the volume of the lamp resulting in a homogeneous discharge. The excitation pulses from the circuit are separated by relatively long "idle" or "off" periods, typically in the range 5–2000 $\mu$s (or 500 Hz–200 kHz), 5–1000 $\mu$s, 5–1500 $\mu$s, 5–750 $\mu$s, 5–500 $\mu$s, 5–250 s, 5–100$\mu$s, 250–800 $\mu$s, 275–800 $\mu$s. 275–700 $\mu$s, 275–600 $\mu$s. 275–500 $\mu$s, 275–400 $\mu$s, 275–350 $\mu$s, 275–325 $\mu$s, where the applied voltage is set to zero and where no plasma excitation occurs in the discharge chamber or a value other than 0 volts and where no plasma excitation occurs discharge chamber. Typically, excitation pulses from the circuit are separated by relatively long "idle" or "off" periods, of 5, 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 425, 450, 475, 500, 550, 600, 650, 700, 750, 800, 1000, 1250, 1500, 1750 or 2000 microseconds.

The amplitude of the unipolar voltage pulses is dependent on lamp geometry and required output but is usually between 0.5 kV–70 kV, 3 kV–50 kV, or 5 kV–30 kV, 5 kV–25 kV, more usually between 5 kV–20 kV, 5 kV–17 kV, 5 kV–16 kV, 5 kV–15 kV, 6 kV–15 kV, 6 kV–14 kV and even more typically between 6 kV–13 kV. The amplitude of the unipolar voltage pulses may be, for example, 1 kV, 2 kV, 3 kV, 4 kV, 5 kV, 6 kV, 7 kV, 8 kv, 9 kV, 10 kV, 11 kV, 12 kV, 13 kV, 14 kV, 15 kV, 16 kV, 17 kV, 18 kV, 19 kV, 20 kV, 25 kV, 30 kV, 35 kV, 40 kV, 45 kV, 50 kV, 55 kV, 60 kV, 65 kV or 70 kV. Usually the amplitudes of the unipolar voltage pulses are less than about 16 kV. The amplitude of each of the unipolar voltage pulses may be the same or different.

The voltage waveform pulse duration is typically in the range 0.05 to 5, 0.1 to 4, 0.1 to 3, 0.1 to 2.5, 0.1 to 2, 0.1 to 1.75, 0.1 to 1.5, 0.1 to 1.25, 0.1 to 1, 0.1 to 0.75, 0.1 to 0.5, 0.5 to 1.5, 0.5 to 1.25, 0.5 to 1, 0.5 to 0.75, 0.75 to 1.5, 0.75 to 1.25, 0.75 to 1, 1 to 1.5, 1 to 2, or 0.9 to 1.1 microseconds. The pulse duration is typically 0.05, 0.1, 0.2, 0.3, 0.4, 0.5, 0.6, 0.7, 0.8, 0.9, 0.95, 1.0, 1.05, 1.1, 1.15, 1.2, 1.25, 1.3, 1.4, 1.5, 1.6, 1.7, 1.8, 1.9, 2.0, 2.5, 3, 3.5, 4.0, 4.5 or 5.0 microseconds.

Usually the interpulse voltage level is 0 volts or at a voltage level whereby no discharge occurs between the two electrodes in the system. More usually the interpulse voltage level is 0 volts or at a voltage level which is substantially below the voltage level whereby a discharge occurs between the two electrodes in the system (typically in the range between 0 volts up to 75%, 0 volts up to 50%, 0 volts up to 25%, 0 volts up to 10% or 0 volts up to 5% of the voltage level whereby a discharge occurs between the two electrodes in the system).

As well as optimising the excitation circuitry for high peak power operation it has been found that higher gas pressures are needed for this new type of operation than are typical for standard DBD lamps. Typically, for high peak power operation (and for other operations, if required) the gas pressure in the discharge chamber is greater than 1 atmosphere pressure. Typically the gas pressure in the discharge chamber is in the range of from about 1.001 atmospheres–3 atmospheres, 1–5 atms, 1–3 atms, 1–2 atms. 1.001–2.5 atms, 1.001–2 atms, 1.001–1.75 atms, 1.001–1.5 atms or 1.001–1.3 atms especially for high peak power operation. The gas pressure may be below atmospheric for certain uses (for example, high efficiency operation and in some instances high peak power operation). Where the gas pressure is below or at atmospheric pressure it is typically in the range of 180 to 760 torr, more typically to 250 to 760, more typically 350 to 760, and even more typically 400 to 760 and yet even more typically 500 to 760 or 600 to 760 torr. Usually, the gas pressure in the discharge chamber for high peak power operation is 761, 762, 763, 764, 765, 766, 767, 768, 769, 770, 775, 780, 785, 790, 795, 800, 810, 820, 830, 840, 850, 875, 900, 925, 950, 975, 1000, 1050, 1100, 1150, 1200, 1250, 1300, 1350, 1400, 1450, 1500, 1550, 1600, 1650, 1700, 1750, 1800, 1850, 1900, 1950, 2000, 2050, 2100, 2200, 2300, 2400 or 2500 torr.

The risetime of the voltage pulse is typically in the range of 5 to 1300, 10 to 1250, 15 to 1150, 20 to 1100, 25 to 1050, 30 to 1000, 35 to 950, 50 to 900, 75 to 850, 100 to 800, 100 to 750, 100 to 720, 100 to 700, 100 to 675, 100 to 650, 100 to 625, 100 to 600, 100 to 575, 100 to 550, 100 to 525, 100 to 500, 100 to 475, 100 to 450, 100 to 425, 100 to 400, 100 to 375, 100 to 350, 100 to 325, 100 to 300, 100 to 275, 100 to 250, 100 to 225, 100 to 200, 100 to 175, 100 to 150, 100 to 125, 125 to 350, 125 to 300, 125 to 250, 125 to 225, 125 to 200, 125 to 175, 125 to 150, 150 to 325, 1,50 to 300, 150 to 275, 150 to 250, 150 to 225, 150 to 200, 150 to 175, 175 to 325, 175 to 300, 175 to 275, 175 to 250, 175 to 225, 175 to 200, 200 to 350, 200 to 325, 200 to 300, 200 to 275, 200 to 250, 200 to 230, 200 to 225, 200 to 220, 200 to 210, 200 to 400, 200 to 350, 200 to 500, 200 to 450, 200 to 425, 210 to 400, or 220 to 250 nanoseconds. The risetime of the voltage pulse is typically 50, 60, 70, 80, 90, 100, 110, 120, 130, 140, 150, 160, 170, 180, 190, 200, 205, 210, 220, 230, 240, 250, 260, 270, 280, 290, 300, 310, 320, 330, 340, 350, 360, 370, 380, 390, 400, 450, 500, 550, 600, 700, 800, 900, 1000, 1100, 1200, or 1300 nanoseconds.

The methods and systems of the invention are capable of providing a source of high-peak-power incoherent ultraviolet (UV) light (80–350 nm, more typically 11–320 nm). The high-peak-power mode of operation is made possible by the method of the invention using a short-pulse excitation scheme of a plasma lamp of the dielectric barrier discharge (DBD) type. Although there has been considerable effort worldwide in developing DBD lamp technology as efficient sources of high-average power UV over the past ten years, no attention has been directed towards operating these lamps to generate short-pulse, high-peak-power UV output. Such a source of high-peak-power UV radiation may be used for a variety of industrial applications relating to surface modification (ablation and chemical reactions) and materials processing for which processing rates are strongly dependent on the rate of UV energy density deposition and which may be characterised by a threshold fluence. This category of materials processing cannot be easily undertaken with commercial DBD lamps currently available as these operate with high-average power, but low-peak-power UV output and hence yield poor performance such as low etch rates. More commonly, laser-based sources of high-peak power UV radiation are used for such applications. Several different output wavelengths are possible from DBD lamps depending on the gas mixture used in the discharge namely, XeCl (308 nm), KrF (248 nm), KrCl (222 nm), ArCl (175 nm), XeF (354 nm), XeI (253 nm), XeBr (283 nm), $KrI^+$ (190 nm) KrBr (207 nm), ArBr (1.65 nm), $Xe_2^+$ (172 nm), $Kr_2^+$ (146 nm) and $Ar_2^+$ (126 nm) and $Ne_2^+$ (88 nm), and $He_2^+$. The methods of the invention may be applied to provide short pulsed, high peak power output is applicable to DBD lamps based on all these gas mixtures.

The discharge gap is in the range in which a substantially homogeneous discharge can take place and be stably sustained. Usually the discharge gap is less than or equal to about 10 mm. Typically the discharge gap is in the range 0.5 to 10 mm, more typically 1.0 to 7 mm, more typically 1.5 to 5 mm, and more typically 2 to 3 mm.

To operate a dielectric barrier discharge (DBD) lamp, being a source of incoherent ultraviolet (UV) radiation, in a manner whereby the UV generated by the DBD appears in the form of single (and intense) pulses of short duration (e.g. 50–500 ns) during each cycle of the lamp excitation, these pulses constituting high peak-power UV output. The lamp geometry, operating conditions and procedures are optimised so as to maximise the peak power of the individual UV output pulses.

This mode of operation is achieved through the use of pulsed electrical excitation (in particular using voltage pulses with rapid rise times) and by optimising the lamp operating parameters so as to increase the production rate (and shorten the formation time) of the dimer molecules from which the UV radiation is derived. An important characteristic of the high-peak power operation is that the UV radiation is often generated (but not necessarily) from a spatially uniform or homogeneous discharge plasma, rather than a filamentary type (streamer) plasma more commonly associated with conventional AC excited DBD lamps. The cause of the homogeneous discharge is thought to be caused by the rapid rate at which the applied E-field reaches the necessary condition for homogeneous discharge to occur at a faster rate than the formation of filaments. It is thought that the fast application of the applied E-field to the electrodes leads to a spatially uniform electron avalanche such that the discharge breakdown is caused to occur in a homogeneous fashion.

These operating procedures could be applied in principal to existing DBD lamp configurations, which have been almost exclusively, excited by AC power supplies up until the present invention. By following the method of the invention the characteristics of the UV output from low-peak power (AC excited) usually characterised by a periodic pattern of multiple filamented (ie streamer) micro-discharges over the dielectric surface change to a substantially pale blue (in the case of UV radiation from Xenon) homogeneous (glow like) discharge (pulsed excitation) over the dielectric surface. Further, by following the high peak power method of operation disclosed herein, the dielectric barrier discharge lamp may be operated in high peak power mode (pulsed excitation).

In DBD plasma lamps utilizing a single atomic species of a noble or rare gas R, the UV emission is derived from the radiative decay of the $R_2^*$ dimer molecule produced in the plasma via kinetic reactions. To obtain high peak-power UV output from such a lamp, it is necessary to ensure that the $R_2^*$ dimers are generated as quickly as possible, and that the production rate is uniformly fast throughout the plasma volume. The pulse width of the UV output is then ultimately governed by (and limited by) the lifetime for radiative decay of the dimer (e.g. $\tau$~5 ns for $Xe_2^{*1}\Sigma_u^*$ and $\tau$~100 ns for $Xe_2^{+}{}_3\Sigma_u^*$). To this end, power must be deposited in the plasma on a timescale which must be comparable to, or faster than, the conversion time of rare gas excited states R* into dimers $R_2^*$ so that the production rate (or formation time) of $R_2^*$ is not limited, by formation time of excited states R*. The production rate of $R_2^*$ from R* can be increased by raising the gas pressure (density of R) as in (2).

| | |
|---|---|
| $e + R \Rightarrow R^* + e$ | (electronic excitation) (1) |
| $R^* + R + R \Rightarrow R_2^* + R$ | (conversion to dimer) (2) |
| $R_2'' \Rightarrow R + R + h\nu$ | (UV emission) (3) |

Using voltage pulses with fast rise times (e.g. $\tau$~50 ns–1000 ns, more typically 50 ns–500 ns) and optimising the lamp operating parameters, electrical power is deposited in the plasma on the requisite timescale for rapid R* production, by virtue of the single (and relatively large) current pulse of short duration ($\tau$<50 ns) which is observed. (Note: in conventional AC excited DBDs, multiple discharge current pulses of relatively low amplitude are observed during the cycle of the AC voltage waveform). The total number of UV photons generated in the plasma (directly affecting, the peak power) is dependent on the number of R* species generated when power is deposited in the plasma. Thus, it is preferable to select operating conditions such that the plasma excitation for R* production is optimised and is homogeneous throughout the plasma volume. An important feature of the present invention for high peak power operation is that a homogeneously excited plasma will avoid "dead-zones" of gas excitation between filament columns as found with conventional AC excited DBD's.

Practically, the voltage pulse risetime is found to be critically important in maintaining a homogeneous discharge plasma. In fact, using very short voltage pulses permits the DBD to operate at a higher pressure than for an AC excited DBD whilst maintaining homogeneous plasma excitation. This is an important advantage of using fast voltage pulses since a higher operating pressure favours rapid conversion of R* to $R_2^*$ as in (2) to achieve short pulse high-peak power UV output.

Variables that may be altered include the usual ways of optimisation of UV output "power", increasing repetition rate raises average output power (but not peak power), using thinner dielectrics, changing $\epsilon$ dielectric material, electrode geometry, gas pressure, electrode area, electrode spacing, interpulse period, interpulse voltage amplitude (typically at 0 volts or at a level whereby there is no lamp discharge) and initial conditions. Gases and mixtures thereof which may be utilised to provide high-peak power UV/VUV include He, Ne, Ar, Kr, Xe, F, Cl, Br, and mixtures thereof. Bipolar or other suitable voltage pulses may also be used. Any suitable lamp geometry and electrode configuration may be used including a cylindrical configuration, flat or coaxial designs, for example.

Typically, the performance of a DBD lamp is determined as a function of various discharge parameters These include buffer gas pressure, physical separation between the dielectric surfaces (cell-width), excitation peak voltage risetime of applied voltage pulse, duration of applied voltage pulse, time delay between voltage pulses (or interpulse period), interpulse voltage level (typically ~0 volts). Specifically, DBD lamp performance may be monitored and assessed using the following electrical and spectroscopic measurements:

- Time-resolved (a) voltage waveforms using a high-voltage probe and wide-bandwidth (500 MHz) digital oscilloscope, (b) current waveforms from the voltage drop across a series resistor;
- Displaced charge through the lamp plasma by monitoring the voltage on a series capacitor;
- Electrical energy deposition calculated by integrating the displaced charge with respect to the applied voltage over each complete cycle;
- Examination of the voltage/charge Lissajous figures (yields useful information on the lamp electrical breakdown characteristics, and the plasma impedance in pulsed DBDs in the period corresponding to the trailing edge of the voltage pulse).
- Temporal evolution of the UV/VUV output pulses (e.g. by detection on a sodium salicylate phosphor for conversion to visible wavelengths and detection by a standard photomultiplier);
- Absolute UV/VUV output power measurements using a calibrated silicon pn photo-diode and optical double-aperture system to define solid-angle and lamp emission area.
- Visible emission spectra 320 nm–600 nm using a 0.5 m SPEX spectrometer arid $N_2$ purge (VUV output at 160–180 nm appears in second-order).
- Time-resolved population densities of Xe* $1s_5$ and $1s_4$ low-lying levels by absorption at 462.6 nm and 492.5 nm using a frequency tripled YAG pumped dye-laser. Formation of $Xe_2^*$ dimers (yielding VUV output) proceeds via the $1s_5$ & $1s_4$ levels (analogous levels for Ar and Kr and other gases may be similarly detected).

This invention provides relatively inexpensive systems and methods to generate incoherent UV/VUV light pulses whose properties (short duration, high-peak-power) can be specifically targeted at a wide range of applications including industrial materials processing. The systems of the invention provide low-cost sources of incoherent UV/VUV light covering a broad range of wavelengths, typically 110 to 320 nm. The systems and methods of the invention have the potential to replace the use of high-cost ultraviolet pulsed lasers to dramatically Improve commercial viability in some manufacturing processes. In addition the invention is expected to lead to new applications due to the low-cost UV/VUV light that the systems and methods of the invention are able to supply where the current commercial viability of the manufacturing process or applications is inhibited by the high cost of existing laser sources.

The method of the invention based on pulsed DBD lamp is applicable to a raft of surface cleaning, surface modification, moderate-threshold-ablation/etching processes and UV light assisted deposition of materials as well as being a potential optical pump source for several laser gain media and a potential means of killing micro-organisms and bacteria. Currently, short pulse laser sources (predominantly Nd:YAG at 1.06 $\mu$m, KrF excimer lasers at 248 nm, frequency quadrupled Nd:YAG at 266 nm and frequency doubled copper vapour lasers at 255 nm) are employed for micromachining of materials such as polymers, metals; removal of micron and submicron sized particulates from surfaces as varied as silicon wafers, silica glass, magnetic head sliders (either with or without assistance by surface layers of water or solvents); removal of hydrocarbon (e.g. fingerprints) and other chemical contaminants from silicon, glass, metals, stone etc without removal of the base material, ablation of polymers; dehydroxylation of silica surfaces (glass) rendering them more hydrophobic and hence resistant to adhesion by many surface contaminants. The mechanisms by which the necessary physical processes occur include direct momentum transfer, photodecomposition (chemical bond breaking and changing), photothermal effects and thermal expansion of the substrate and/or contaminants and/or assisting liquid/vapour layers.

Application of a pulsed DBD lamp by method of the invention to surface cleaning involves, depending on the particular application, a lamp which delivers the UV/VUV emission from a large area lamp (typically 5 $cm^2$–10000 $cm^2$, more typically 25–1000 $cm^2$) onto a smaller area to be processed. The UV/VUV emission can be conditioned into a line source at the sample position by one-dimensional curvature or a spot source by two-dimensional curvatures of the UV/VUV pulsed DBD or a surrounding reflector. The sample to be processed is translated in the plane of the maximum power per unit arena. A nitrogen purge can be used in the volume in which the UV/VUV emission propagates. Threshold fluences for removal of micron and submicron particles from surfaces are typically 1 $mJ/cm^2$–10 $J/cm^2$, more typically 10 $mJ/cm^2$–1 $J/cm^2$, even more typically 50 $mJ/cm^2$–400 $mJ/cm^2$. Single pulse or multiple pulses can be used. More usually multiple pulses are required.

The cleaning efficiency increases with fluence above the threshold fluence The functional form of cleaning efficiency versus fluence depends on the spatial irradiance variation of the emission at the sample being processed The system may be housed in a vacuum chamber for some applications. Shorter wavelengths are in general more effective at cleaning surfaces (in the absence of any solvent assistance) but care must be taken to avoid any damage to the surface occurring in parallel with the cleaning, particularly at shorter wavelengths. Such cleaning of particulates has been affected in the prior art using pulsed laser sources.

One useful surface modification is the semi-permanent dehydroxylation of native silica glass surfaces. This can be affected with short pulse, high peak power UV/VUV emission from the invention. This can involve a geometry for the pulsed DBD lamp, or the system in which it is housed, which delivers the UV/VUV emission from a large area lamp onto a smaller area to be processed. The UV/VUV emission can be conditioned into a line source at the sample position by one-dimensional curvature or a spot source by two-dimensional curvatures of the UV/VUV pulsed DBD or a surrounding reflector. The sample to be processed is translated in the plane of the maximum power per unit area. A nitrogen purge can be used in the volume in which the UV/VUV emission propagates. The fluence at the processing sample is typically 1 $mJ/cm^2$ to 1 $J/cm^2$, more typically 10 $mJ/cm^2$ to 500 $mJ/cm^2$ and even more typically 100 $mJ/cm^2$ to 200 $mJ/cm^2$. The number of pulses of the emission that treat each area element of the sample (which is translated) is typically 1 to $10^6$, more typically 10 to $10^5$ and even more typically 100 to $10^4$. The percentage of dehydroxylation (as determined from the ratio of $SiOH^+$ to $Si^+$ measured by time of flight secondary ion mass spectrometry (TOF SIMS)) is a function of both the fluence and number of pulses used. As a result of the treatment the sample is rendered more hydrophobic than native silica surfaces. Such dehydroxylation of silica glass surfaces has been affected in the prior art using UV pulsed laser sources. Photolithographic masking can be used to produce spatially patterned dehydroxylation.

Material etching/ablation applications (with moderate ablation threshold fluence) can be illustrated by polymer ablation using the method of the invention. Polymer (examples: PETG, poliimide, PET, PMMA) ablation has been affected in prior art by a variety of UV/VUV lamps and lasers The ablation/etching rates that can be affected by method of the invention cover most of the range of etch rates reported for AC DBD excimer lamps and UV pulsed lasers depending on whether the output from the invention is intensified as described above. Ablation/etch rates per pulse depend on fluence, pulse repetition frequency and material. Typical rates are between picometres per pulse and 0.1 $\mu$m per pulse depending on whether the process proceeds sub-threshold or sup-threshold.

BEST MODE AND OTHER MODES FOR CARRYING OUT THE INVENTION

Figure 1:
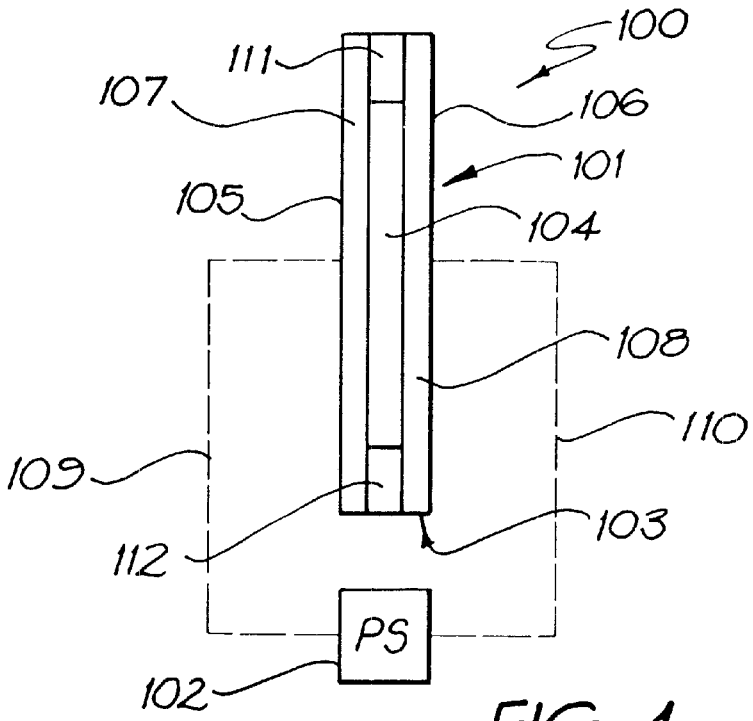
FIG. 1 is a schematic diagram of a system for providing emission of a high peak power incoherent radiation.
Figure 2:
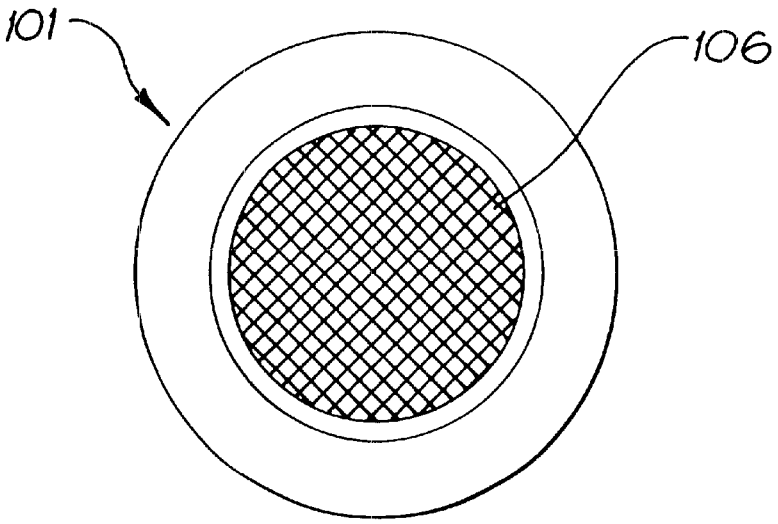
FIG. 2 is a front view of an electrode in the system of FIG. 1.
Figure 3:
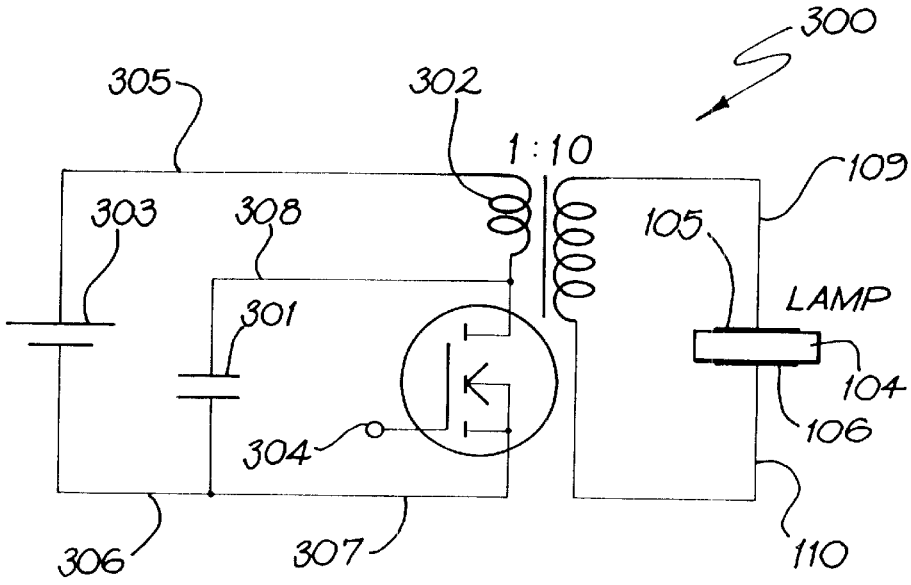
FIG. 3 is a circuit diagram of one preferred power supply for use in the system of FIG. 1.
Figure 4:
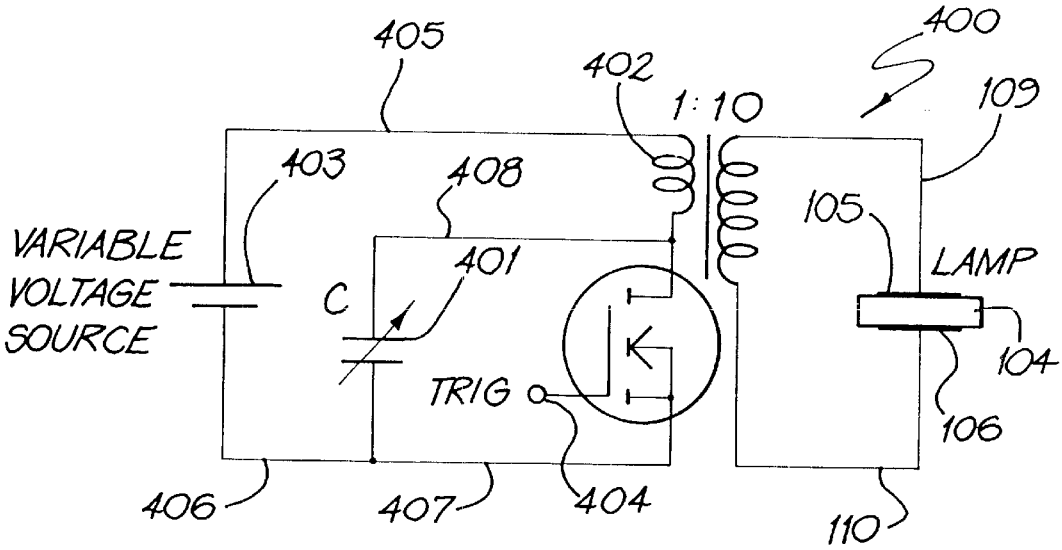
FIG. 4 is an alternative circuit diagram of a power supply for use in the system of FIG. 1.

A system 100 for providing emission of high peak power incoherent radiation is depicted in FIG. 1. System 100 comprises an electrically impeded flat discharge lamp 101 linked to an electrical power supply 102. Referring to FIG. 1. lamp 101 comprises a discharge chamber 103 which is at least partially transparent to the incoherent radiation, a discharge gas 104 in chamber 103, two mesh grid electrodes 105 and 106 disposed in chamber 103 for discharging electrical energy there between, and two transparent dielectric barriers 107 and 108 disposed between the two electrodes 105 and 106 to electrically impede electrical energy passing between electrodes 105 and 106. The width of the discharge space in discharge chamber 103 is determined by spacers 111 and 112. Discharge gas 104 is typically at a pressure in the range of greater than 0.5 atm up to about 3 atm. An electrical energy supply 102 capable of providing fast risetime, unipolar voltage pulses is electrically linked to electrodes 105 and 106 via lines 109 and 110. FIG. 2 depicts a front on view of lamp 101 depicting a front on view of grid electrode 106. FIG. 3 depicts one example of a power supply 300. Power supply 300 is capable of providing a sequence of unipolar voltage pulses from energy supply 300 to electrodes 105 and 106 via lines 109 and 110. Supply 300 has a capacitor 301, which is chosen such that the risetime of the voltage pulse is typically in the range 10 to 2000 ns, more typically 10 to 1200 ns and more typically 10 to 700 ns. The amplitude of the voltage pulse supplied to electrodes 105 and 106 via 1:10 transformer 302 is dependent on voltage source 303, which typically supplies a voltage in the range of 0.5 kV to 70 kV and/or the 'on time' of the FET 304. The period between the voltage pulses is controlled by the trigger rate of FET 304, the trigger rate being typically in the range of 500 Hz to 200 kHz Voltage source 303 is in parallel with transformer 302 and FET 304 via lines 305 and lines 306 and 307. Capacitor 301 is arranged in parallel with FET 304 via line 308; as well as line 307. FIG. 4 depicts another example of a power supply 400. Power supply 400 is capable of providing a sequence of unipolar voltage pulses from energy supply 400 to electrodes 105 and 106 via lines 109 and 110. Supply 400 has a variable capacitor 401, which is chosen such that the risetime of the voltage pulse may be varied in the range 10 to 1200 ns. The amplitude of the voltage pulse supplied to electrodes 105 and 106 via 1:10 transformer 402 is dependent on variable voltage source 403, which typically supplies a voltage, which may be varied in the range of 0.5 kV to 70 kV and/or the 'one time' of the FET. The period between the voltage pulses is controlled by the trigger rate of FET 404, the trigger rate being typically in the range of 500 Hz to 200 kHz. Voltage source 403 is in parallel with transformer 402 and FET 404 via lines 405 and lines 406 and 407. Capacitor 401 is arranged in parallel with FET 404 via line 408, as well as line 407. Power supply 400 generates voltage pulses whose characteristics can be tuned independently to achieve best performance from the lamp 101 with respect to high peak power output of the ultraviolet light. The risetime of the voltage pulse (typically 30 to 1000 ns) is controlled by varying capacitor 401. The amplitude of the voltage pulse is controlled by a D. C. variable voltage source (1 kV–50 kV) and/or the 'on time' of the FET. The period between pulses (interpulse pulse period or idle time) is controlled by the trigger rate of FET (500 Hz–200 kHz).

It is not readily possible (nor desirable) to specify a single set of circuit parameters for, optimum high peak power operation over a wide range of pressures. For each gas pressure (>0.5 atm) used in the lamp (and indeed for different gas types), the circuit parameters of supply 400 must be tuned and/or adjusted to achieve optimum high peak power operation. For example, any changes made to voltage pulse (peak) amplitude will usually require readjustment of a voltage risetime to maximise high peak power VUV output.

In use, system 100 is operated so as to provide emission of high peak power incoherent radiation, by providing a sequence of unipolar high voltage pulses from supply 300 or 400 to electrodes 105 and 106 and controlling (i) interpulse period, (ii) pulse risetime, (iii) pulse width, and interpulse voltage level (typically 0 volts) by adjusting the parameters of supply 300 or 400, whereby a substantially homogeneous discharge occurs between electrodes which causes emission of incoherent radiation pulses of high peak power (in Watts) from the surfaces of lamp 101.

EXAMPLES

Figure 5:
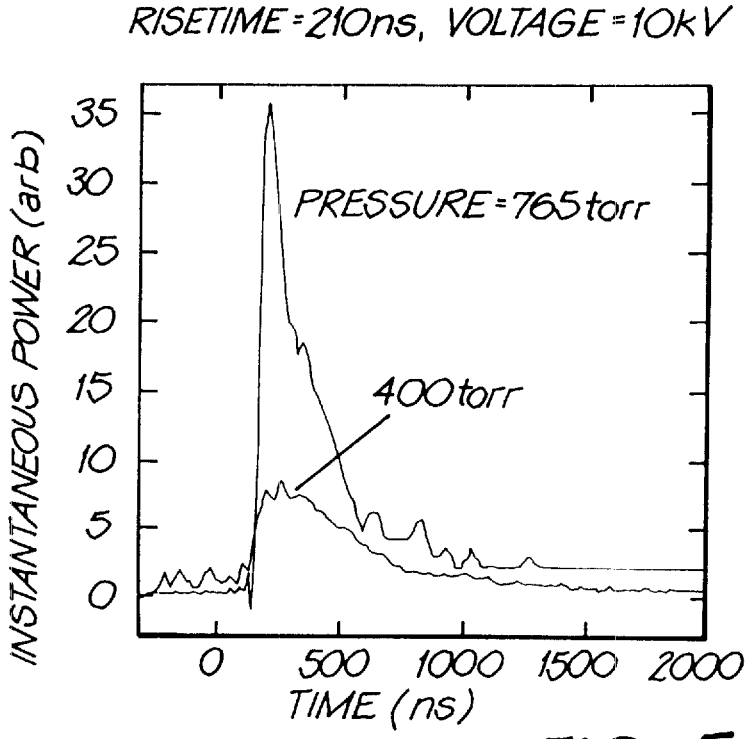
FIG. 5 depicts two graphs of instantaneous output power as a function of time at two different lamp pressures (400 torr and 765 torr)
Figure 6:
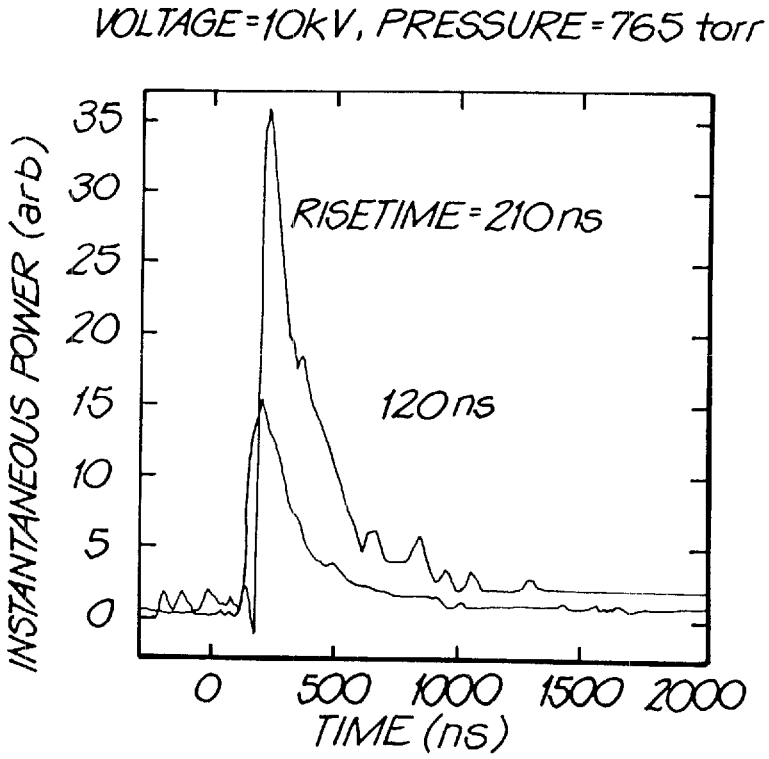
FIG. 6 depicts two graphs of instantaneous output power as a function of time for two different input voltage pulses one having a risetime of 120 ns and the other having a risetime of 210 ns.

Measurements were performed on a system 100 as depicted in FIG. 1, which included a flat lamp 101 containing a 3 mm discharge gap in between two 2 mm thick dielectric windows made of Suprasil. The area of each electrode 105 and 106 was approximately 4 $cm^2$. The lamp 101 was evacuated using a rotary pump (not shown) and filled with Xe (laser grade purity—99.9999%). A FET switched pulsed excitation circuit was used to provide voltage pulses to electrodes 105 and 106. The results are shown in FIGS. 5 to 11, and table 1. The results show that the short-pulsed, excitation method leads to the production of a single pulse of VUV emission during each excitation cycle characterised by high peak power, compared to the VUV emission typically observed for AC excitation The results also show that the operating conditions to optimise high peak power output are different to those required for optimising the overall efficiency. FIG. 5 illustrates the marked increase in high peak power VUV output for lamp operation above 760 torr. The output occurs in regular short pulses (<300 ns FWHM) with instantaneous peak power more than six times the peak power typically obtained at 400 torr. VUV output is emitted from the pulsed lamp during the short period (<2 $\mu$s) immediately after the discharge current pulse. As shown in FIGS. 5 and 6 for a pressure of 765 torr, the instantaneous power increases rapidly (ie. within 400 ns) to the peak value and decays approximately exponentially thereafter. Although the time constant for this decay (~200 ns) is uniform over the investigated pressure range (50–765 torr), the initial rate of increase of the output power and the peak amplitude increase markedly with pressure. For 765 torr, the initial rate of increase and the peak power are approximately twice that observed at 400 torr (refer to FIG. 5). Other experiments by us have found that when using AC excitation, the pulse shape of single micro-discharges is similar to that obtained at the same pressure using pulsed excitation. The instantaneous peak power of VUV output is much lower, however, since multiple output pulses are produced during each discharge cycle in addition to the overall reduction in output pulse energy per cycle (by factor of approximately three). As a result, the instantaneous peak power for pulsed excitation is more than six times the averaged peak power of pulses obtained with AC. The applied voltage pulse characteristics (risetime 210 ns, peak voltage 10 kV) are the same when the lamp 101 was operated at 400 torr and 765 torr.

FIG. 6 illustrates the importance of the voltage pulse risetime to attain high peak power of VUV output, for a fixed gas (Xe) pressure (765 torr) and peak voltage (10 kV). This figure indicates for the particular set of parameters used that a voltage pulse risetime of 210 ns is more optimal than a voltage pulse risetime of 120 ns. The influence of the voltage pulse risetime on the electrical input pulse energy, VUV output pulse energy, instantaneous peak VUV power, and the efficiency is shown in the examples given in table 1 for two different lamp pressures (400 torr and 765 torr). The examples clearly demonstrate that for pulsed excitation the operating conditions to achieve the highest instantaneous peak power (and highest output pulse energy) are not the same as those required to attain the highest operating efficiency.

TABLE 1

Electrical and optical lamp characteristics for different voltage risetimes and gas pressures

| Voltage pulse risetime (ns) | Input pulse energy (μJ) | VUV output pulse energy (arb. units) | Instantaneous peak power (arb. Units) | Efficiency (arb. units) |
|---|---|---|---|---|
| 400 torr | | | | |
| 95 | 19.4 | 6.6 | 6.4 | 3.39 |
| 120 | 28.9 | 8.2 | 7.6 | 2.82 |
| 210 | 54.1 | 8.8 | 8.5 | 1.64 |
| 765 torr | | | | |
| 120 | 23.6 | 10.3 | 15.5 | 4.39 |
| 210 | 98.6 | 24.0 | 35.7 | 2.43 |

Figure 7:
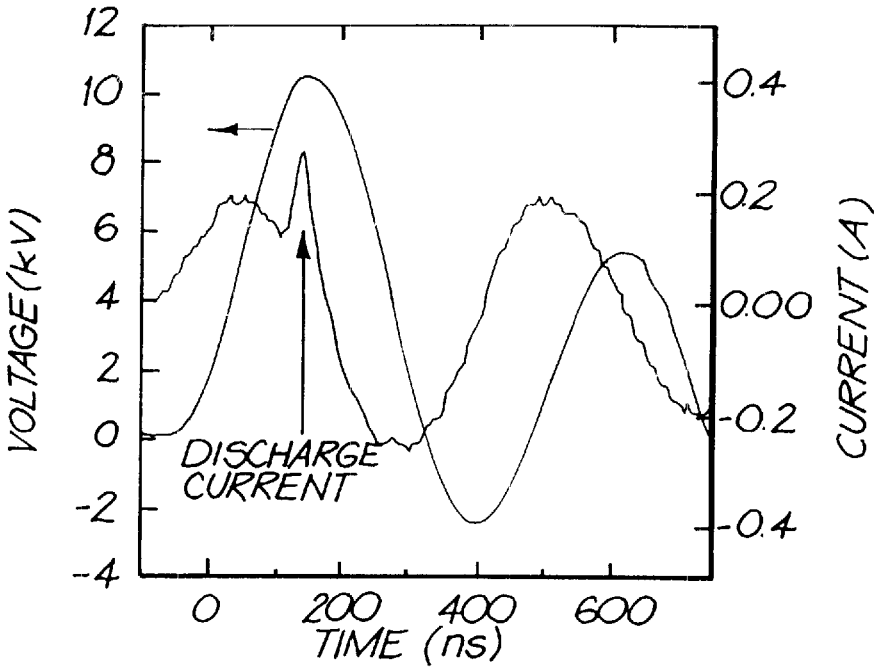
FIG. 7 depicts lamp voltage and current waveforms.
Figure 8:
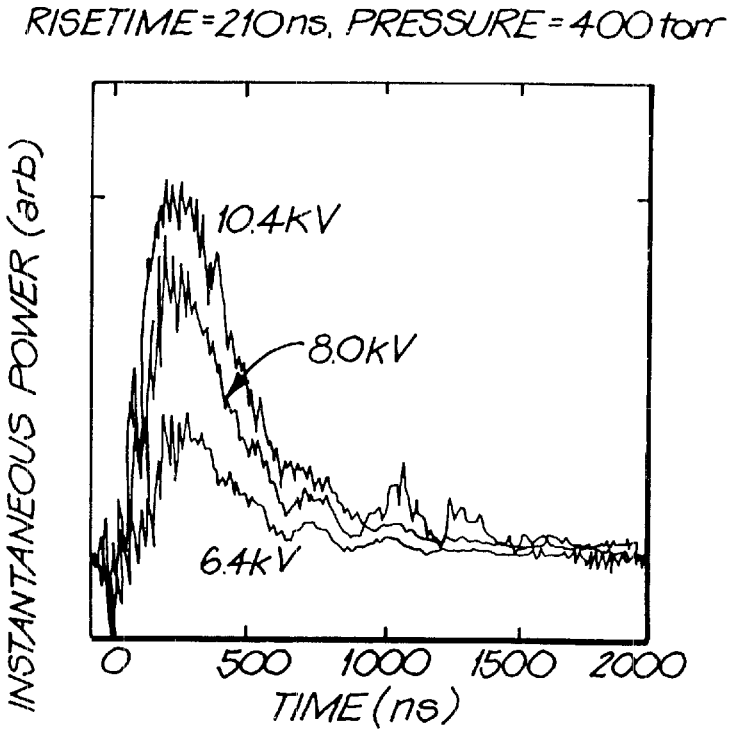
FIG. 8 depicts three graphs of instantaneous output power as a function of time for three different input voltage pulses the first having a peak amplitude of 6.4 kV, the second having a peak amplitude of 8.0 kV, the third having a peak amplitude of 10.4 kV.
Figure 9:
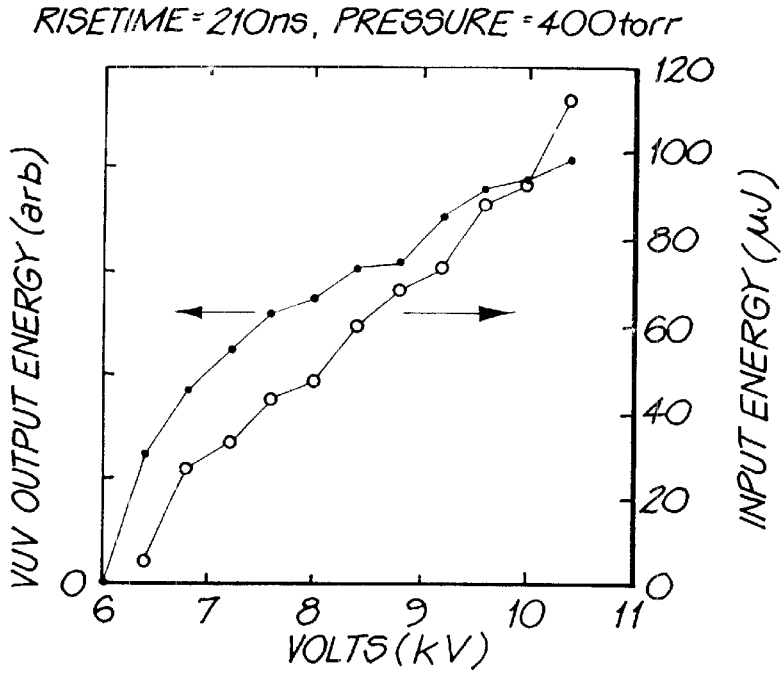
FIG. 9 depicts a graph of the VUV output pulse energy as a function of the peak amplitude of the applied voltage pulse and a graph of the input pulse energy in microjoules as a function of the amplitude of the applied voltage pulse.
Figure 10:
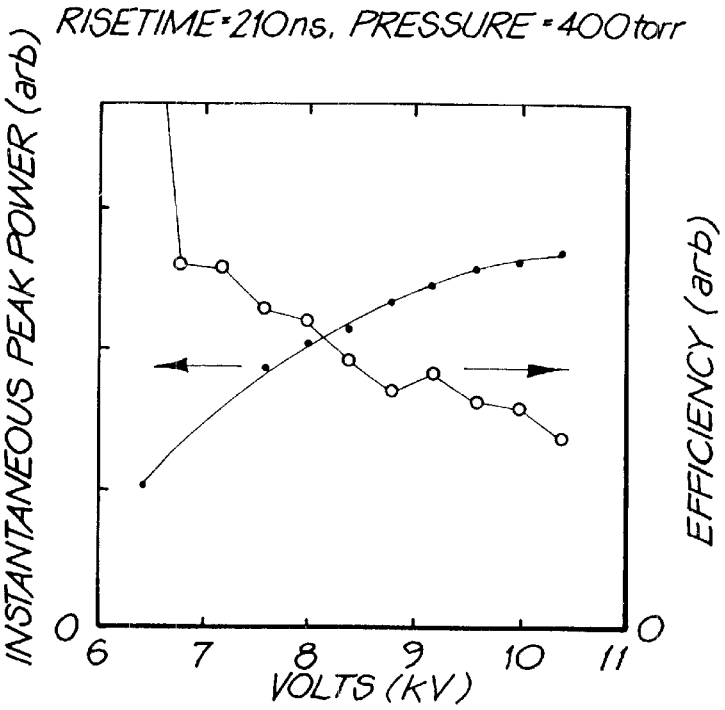
FIG. 10 depicts a graph of the instantaneous peak power of the VUV output as a function of the amplitude of the applied Voltage pulse and a graph of the efficiency as a function of the amplitude of the applied voltage pulse.

FIG. 7 shows typical current-voltage waveforms for high peak power operation at a gas pressure of 765 torr. For the voltage pulse risetime used (~210 ns), the discharge current pulse occurs at a time when the applied voltage is close to maximum (10 kV). In general, high peak power VUV output is maximised when the discharge current and peak voltage are nearly coincident in time. The lamp current and voltage waveforms that are depicted in FIG. 7 are displayed on a timescale that shows risetime well resolved. FIG. 8 shows the instantaneous VUV output power as a function of time for three different input voltage pulses (peak amplitudes 6.4 kV, 8.0 kV and 10.4 kV). The graph shows that the instantaneous peak power steadily increases as the peak voltage is raised. The VUV output pulse duration (~1 μs), pulse risetime (~200 ns) and decay rate does not change significantly for the three input voltage pulses. FIG. 9 shows the VUV output pulse energy and the input electrical pulse energy (in μJ) as a function of the peak amplitude of the applied voltage pulse. The graph shows a steady increase in both the deposited electrical energy per pulse and the VUV output energy per pulse as the peak voltage is raised. The overall efficiency (calculated from the ratio of the VUV output energy and the input electrical energy per pulse) is shown in FIG. 10 as a function of the amplitude of the applied voltage pulse, together with the instantaneous peak power of the VUV output. The graph clearly shows that the maximum efficiency and the maximum peak power occur at different values of the peak voltage. The VUV instantaneous peak power increases as the peak voltage is raised whereas the efficiency decreases as the peak voltage is raised.

Figure 11A:
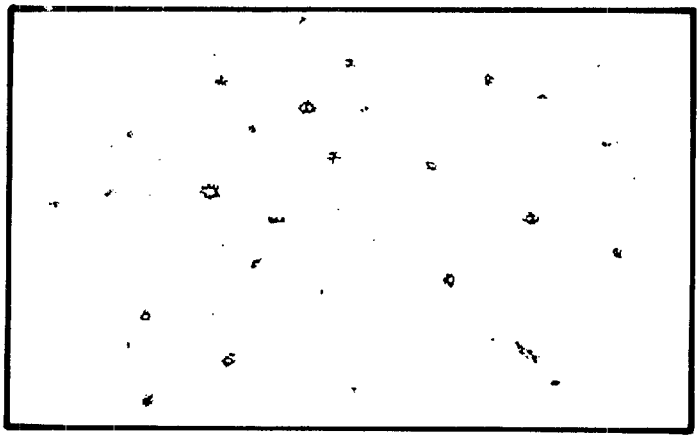
FIG. 11 depicts images of the visible light emitted from the lamp (seen front on through the mesh electrode as shown in FIG. 2) measured using a gaited CCD camera, (a) AC voltage waveform at 3 kHz, 7.5 kV peak to peak, 100 torr pressure, gated for 80 $\mu$s; (b) AC voltage waveform at 3 kHz, 7.5 kV peak to peak, 400 torr pressure, gated for 80 $\mu$s; (c) Pulsed voltage waveform at 8 V, 400 torr pressure, gated for 250 $\mu$s (note: circular dark regions are due to electrode defects)
Figure 11B:
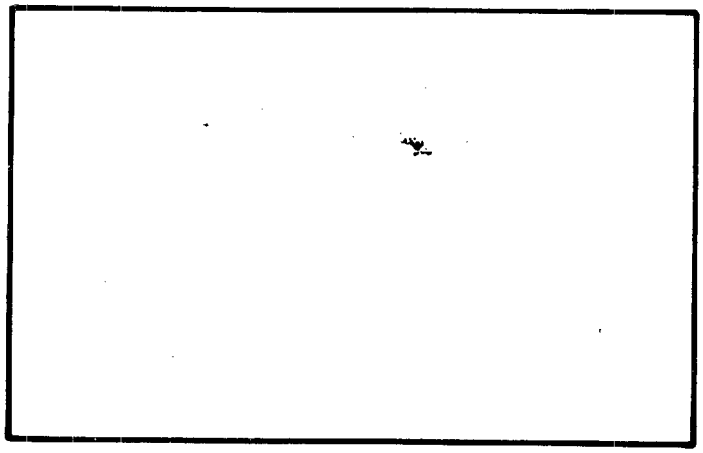
Figure 11C:
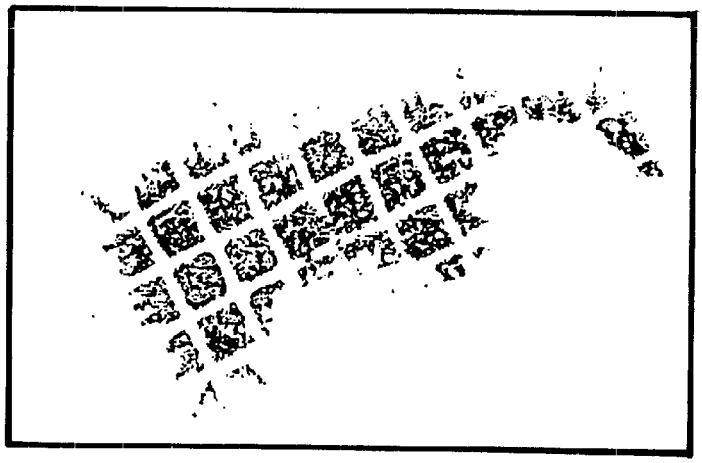

FIG. 11 depicts images of the visible light emitted from the lamp as seen front-on through the mesh electrode shown in FIG. 2. In this experiment, a rectangular shaped rear electrode was employed (4 $cm^2$ cross-section). The images were acquired using a gated intensified CCD camera to observe the visible emission on a timescale corresponding to a single excitation cycle. FIG. 11*a* shows a typical multiple filamentary discharge pattern characteristic of AC excitation (3 kHz, 7.5 kVp-p) at relatively low pressure (100 torr) (the discharge filaments appear as spots in the image since they are being viewed end-on). The cameras was gated for 80 μs to collect visible emission over the first ¼ cycle of a single AC waveform). FIG. 11*b* shows a typical single filament discharge for AC excitation (3 kHz, 7.5 kV p-p) at 400 torr pressure (80 μs gate). More typically at 400 torr, 0–2 filaments are observed under these operating conditions for AC excitation). FIG. 11*c* shows a typical homogeneous plasma observed when employing short pulse excitation (3 kHz, 8 kV peak) at moderate pressure (400 torr) gated for 250 μs (note: circular dark regions are due to electrode defects). Thus, the homogeneous appearance of the visible emission shows that the entire volume in the discharge gap is fully utilized for plasma generation compared to the filamentary appearance seen typically for AC excitation. It is believed that the homogeneous plasma generated by short-pulsed excitation is an important feature for the generation of high power and high peak-power VUV output.

Figure 12:
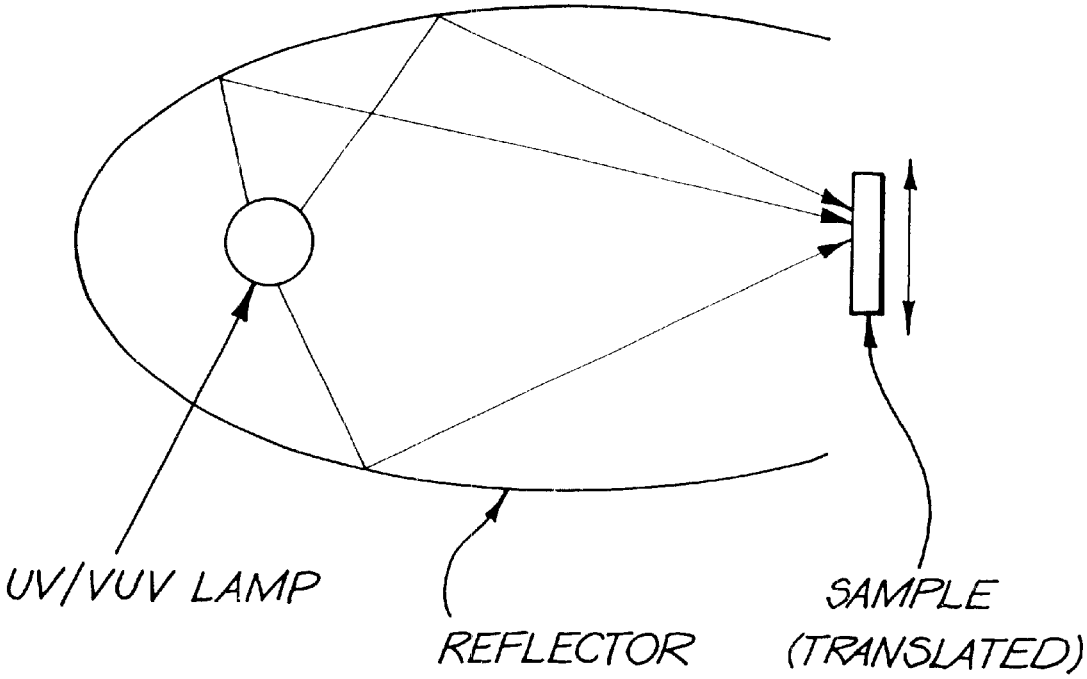
FIG. 12 Schematic diagram for a system to utilize the high peak power UV/VUV lamp output in materials processing applications.

FIG. 12 Schematic diagram for a system to utilize the high peak power UV/VUV lamp output in materials processing applications. The elliptical reflector provides a means to focus the UV/VUV output from the lamp to a focal spot at the sample surface to achieve a higher illumination fluence ($J/cm^2$) or intensity ($W/cm^2$) than possible by placement of the sample in close proximity of the lamp. An inert gas environment (Ar or $N_2$ purge) would be used in the system for VUV processing.

This experiment shows fast risetime pulsed excitation yields a several fold increase in VUV output power and a several fold increase in the instantaneous peak power of VUV output compared to AC excitation. The desired operating conditions for the lamp (gas pressure, voltage pulse risetime, peak voltage, idle time) to attain high peak power VUV output are demonstrated to be different to those for attaining high efficiency operation.

COMPARATIVE EXAMPLES

Two comparative examples are drawn from studies that were carried out using a frequency doubled copper vapour laser for laser cleaning of micron and sub-micron sized alumina particles from silica glass surfaces and our discovery of the semi-permanent dehydroxylation of silica glass using the same source.

Laser Cleaning:

The achievement of 100% cleaning efficiencies was reached for removal of alumina particles as small as 0.3 μm from fused silica and soda glass. The threshold fluence for this dry laser cleaning is a process using a frequency doubled copper vapour laser at 255 nm is ~100 $mJ/cm^2$ corresponding to peak powers of about $3\times10^6$ W in the 35 ns pulses. The threshold for the laser cleaning scales with wavelength. It is approximately 400 $mJ/cm^2$ using a XeCl excimer laser at 308 nm. Laser induced surface optical damage can occur in parallel with the removal of surface particles, particularly when short wavelength, highly coherent (laser) light is used.

It is possible to project what would be expected by operating lamps of equivalent standard to current commercial DBD lamps (operated in AC mode as normally supplied) in an optimised pulsed mode of excitation. Here as much as 1.7 kW of UV/VUV power from a lamp area of 30.0 cm×8.0 cm is emitted, ie 7 $W/cm^2$. For an AC frequency of 10 kHz this follows through to a prediction of single pulse fluence of 0.7 $mJ/cm^2$ and the focusing factor to achieve the benchmark laser cleaning threshold fluence is only ~1/140 (2.5 cm×0.7 cm processing area). Assuming a 200 ns pulse the threshold peak power of $3\times10^6$ W is, also simultaneously achieved for a processing area of about 1.0 cm×0.3 cm (a focusing factor of ~1/860). Design strategies for DBD lamps to produce the necessary fluence/peak power require lamp geometries that scale up fluence and/or concentrate the light into smaller areas, and, optical systems for focussing the UV/VUV emission. These processing areas are similar (and indeed somewhat larger) than laser cleaning systems under commercial development for cleaning silicon waters in semiconductor manufacture. The methods and assistance of the invention are also suitable for the broad range of laser cleaning applications of smaller scale in small and medium sized businesses where a cheaper technology than laser cleaning is required (e.g. photonics applications).

Dehydroxylation of Silica (and Analogous Surface Treatments):

The laser-based studies we have carried out to date have achieved a semi-permanent dehydroxylation of silica glasses using sequences of several hundred pulses of the same peak power and fluences as have been discussed above for laser cleaning. Thus, the same scaling arguments apply to applying DBD lamps to this application as discussed above. This treatment renders glass (which is normally hydrophilic) highly hydrophobic and has potential for producing glass to which most particulates are non-adherent, including small-scale high quality optics and large-scale window glass. The decreased cost of the treatment using lamps rather than lasers may make its application to the bulk glass market feasible. Existing technologies using lasers involve large-scale, high cost systems. The cost can be significantly reduced using DBD lamps.

What is claimed is:

1. A method of operating a system for providing emission of incoherent radiation, said system comprising an electrically impeded discharge lamp linked to an electrical energy supply, said lamp comprising:

(a) a discharge chamber which is at least partially transparent to said incoherent radiation;

(b) a discharge gas in said chamber;

(c) two electrodes disposed with respect to said chamber for discharging electrical energy there between;

(d) at least one dielectric barrier disposed between said two electrodes to electrically impede electrical energy passing between said two electrodes;

(e) an electrical energy supply capable of providing fast risetime unipolar voltage pulses;

(f) means of electrically linking said electrodes with said supply; said method comprising:

providing a sequence of unipolar voltage pulses from said energy supply to said electrodes and controlling (i) interpulse period, and (ii) pulse risetime, whereby a substantially homogeneous discharge occurs between said two electrodes which causes emission of pulses of incoherent radiation from said lamp.

2. The method of claim 1 wherein said method comprises:

providing a sequence of unipolar voltage pulses from said energy supply to said electrodes and controlling (i) interpulse period, (ii) pulse risetime, and (iii) pulse width, whereby a substantially homogeneous discharge occurs between said two electrodes which causes emission of pulses of incoherent radiation from said lamp.

3. A method of operating a system for providing emission of high peak power incoherent radiation, said system comprising an electrically impeded discharge lamp linked to an electrical energy supply, said lamp comprising:

(a) a discharge chamber which is at least partially transparent to said incoherent radiation;

(b) a discharge gas in said chamber;

(c) two electrodes disposed with respect to said chamber for discharging electrical energy there between;

(d) at least one dielectric barrier disposed between said two electrodes to electrically impede electrical energy passing between said two electrodes;

(e) an electrical energy supply capable of providing fast risetime, high peak unipolar voltage pulses;

(f) means of electrically linking said electrodes with said energy supply;

said method comprising:

providing a sequence of high peak unipolar voltage pulses from said energy supply to said electrodes and controlling (i) interpulse period, and (ii) pulse risetime, whereby a substantially homogeneous discharge occurs between said two electrodes which causes emission of incoherent radiation pulses of high peak power from said lamp.

4. The method of claim 3 wherein said method comprises:

providing a sequence of unipolar voltage pulses from said energy supply to said electrodes and controlling (i) interpulse period, (ii) pulse risetime, and (iii) pulse width, whereby a substantially homogeneous discharge occurs between said two electrodes which causes emission of pulses of incoherent radiation of high peak power from said lamp.

5. The method of claim 3 wherein said method comprises:

providing a sequence of unipolar voltage pulses from said energy supply to said electrodes and controlling (i) interpulse period, (ii) pulse risetime, (iii) pulse width, (iv) interpulse voltage level, and (v) unipolar pulse voltage level; whereby substantially homogeneous discharge occurs between said two electrodes which causes emission of pulses of incoherent radiation of high peak power from said lamp.

6. A system for providing emission of incoherent radiation, said system comprising an electrically impeded discharge lamp linked to an electrical energy supply, said lamp comprising:

(a) a discharge chamber which is at least partially transparent to said incoherent radiation;

(b) a discharge gas in said chamber;

(c) two electrodes disposed with respect to said chamber for discharging electrical energy there between;

(d) at least one dielectric barrier disposed between said two electrodes to electrically impede electrical energy passing between said two electrodes;

(e) an electrical energy supply capable of providing fast risetime unipolar voltage pulses;

(f) means of electrically linking said electrodes with said energy supply;

said energy power supply being capable of providing a sequence of unipolar voltage pulses from said energy supply to said electrodes; and means to control (i) interpulse period, and (ii) pulse risetime, whereby, in use, a substantially homogeneous discharge occurs between said two electrodes which causes emission of pulses of incoherent radiation from said lamp.

7. The system of claim 6 comprising:

means to control (i) interpulse period, (ii) pulse risetime, and (iii) pulse width, whereby, in use, a substantially homogeneous discharge occurs between said two electrodes which causes emission of pulses of incoherent radiation from said lamp.

8. A system for providing emission of high peak power (in watts) incoherent radiation, said system comprising an electrically impeded discharge lamp linked to an electrical.energy supply, said lamp comprising:

(a) a discharge chamber which is at least partially transparent to said incoherent radiation;

(b) a discharge gas in said chamber;

(c) two electrodes disposed with respect to said chamber for discharging electrical energy there between;

(d) at least one dielectric barrier disposed between said two electrodes to electrically impede electrical energy passing between said two electrodes;

(e) an electrical energy supply capable of providing fast risetime, high peak power unipolar voltage pulses;

(f) means of electrically linking said electrodes with said supply;

said energy supply being capable of providing a sequence of high peak power unipolar voltage pulses from said energy supply to said electrodes; and means to control (i) interpulse period, and (ii) pulse risetime, whereby, in use, a substantially homogeneous discharge occurs between said two electrodes which causes emission of incoherent radiation pulses of high peak power from said lamp.

9. The system of claim 8 comprising:

means to control (i) interpulse period, (ii) pulse risetime, and (iii) pulse width, whereby, in use, a substantially, homogeneous discharge occurs between said two electrodes which causes emission of pulses of incoherent radiation of high peak power from said lamp.

10. The system of claim 8 comprising:

means to control (i) interpulse period, (ii) pulse risetime, (iii) pulse width, (iv) interpulse voltage level, and (v) unipolar pulse voltage level;

whereby, in use, a substantially homogeneous discharge occurs between said two electrodes which causes emission of pulses of incoherent radiation of high peak power from said lamp.

11. The system of claim 8 wherein the pressure in the discharge chamber is above 1 atmosphere.

12. The system of claim 11 wherein the pressure in the discharge chamber is in the range of from 1.001–2 atmospheres.

13. The system of claim 10 wherein the pressure in the discharge chamber is above 1 atmosphere.

14. The system of claim 13 wherein the pressure in the discharge chamber is in the range of from 1.001–2 atmospheres.

* * * * *